US005975983A

United States Patent [19]

Panec

[11] Patent Number: 5,975,983

[45] Date of Patent: Nov. 2, 1999

[54] REUSABLE WATER-CONTAINING TOY

[76] Inventor: Donald J. Panec, 50 Horgan Ave., #12, Redwood City, Calif. 94061

[21] Appl. No.: 09/097,181

[22] Filed: Jun. 12, 1998

[51] Int. Cl.[6] ..... A63H 33/30; A63H 3/52; B65D 5/72; B65D 3/16

[52] U.S. Cl. ..... 446/475; 446/267; 446/473; 222/494; 141/114; 141/348

[58] Field of Search ..... 446/267, 475, 446/473, 487, 490, 224; 222/494, 491; 141/114, 347, 348

[56] References Cited

U.S. PATENT DOCUMENTS

| | | | |
|---|---|---|---|
| 1,920,257 | 8/1933 | Halland . | |
| 2,105,615 | 1/1938 | Romeis | 222/494 |
| 2,573,424 | 10/1951 | Flamm | 141/348 |
| 2,908,109 | 10/1959 | Rotwein | 446/224 |
| 2,928,437 | 3/1960 | Plows | 141/114 |
| 3,360,169 | 12/1967 | Susuki et al. | 222/494 |
| 4,132,334 | 1/1979 | Danks | 141/348 X |
| 4,212,460 | 7/1980 | Kraft . | |
| 4,314,658 | 2/1982 | Laauwe | 222/494 X |
| 4,867,451 | 9/1989 | Mitchell . | |
| 4,890,838 | 1/1990 | Rudell et al. . | |
| 4,991,847 | 2/1991 | Rudell et al. . | |
| 5,098,329 | 3/1992 | Tseng | 446/224 X |
| 5,176,510 | 1/1993 | Nilsson | 222/494 X |
| 5,240,450 | 8/1993 | Graham . | |
| 5,343,889 | 9/1994 | Jaw | 446/224 X |
| 5,472,021 | 12/1995 | Tsao et al. | 222/491 X |
| 5,472,123 | 12/1995 | Jangaard | 222/494 X |
| 5,496,203 | 3/1996 | Murray | 446/224 X |
| 5,522,757 | 6/1996 | Ostrowski . | |
| 5,531,626 | 7/1996 | Deal . | |
| 5,538,456 | 7/1996 | Liu et al. . | |
| 5,577,732 | 11/1996 | Spector . | |
| 5,649,875 | 7/1997 | Spector . | |

FOREIGN PATENT DOCUMENTS

| | | | |
|---|---|---|---|
| 2244658 | 12/1991 | United Kingdom | 446/267 |

*Primary Examiner*—D. Neal Muir
*Attorney, Agent, or Firm*—Kolisch Hartwell Dickinson McCormack & Heuser

[57] ABSTRACT

A fluid-holding toy including a flexible container capable of holding fluid. The container has a valve configured to be closed upon the introduction of fluid into the container, whereby the fluid creates a first pressure inside the container closing the first valve. The first valve is configured to be opened upon the occurrence of a second, higher pressure inside the container. The valve can include a flexible flap attached to the inner surface of the container and adapted to cover an opening in the container. Additional valves can also be provided.

15 Claims, 3 Drawing Sheets

REUSABLE WATER-CONTAINING TOY

FIELD OF THE INVENTION

The present invention relates generally to water toys. More specifically, the present invention relates to a reusable water-containing toy.

BACKGROUND OF THE INVENTION

Water activities are popular with children of all ages. Not only do swimming and diving enjoy a large following, but many children also find amusement by throwing water at targets. A well-known method of dousing a target with water is to throw a water-filled balloon at the target. However, such balloons are destroyed on impact with the target, and the small balloon pieces are unsafe when used around small children. Accordingly, there is a need to replace the water balloon with a reusable water-retaining projectile that would be safe to use around small children.

To be a satisfactory alternative to the water balloon, a reusable water-containing projectile must retain an appreciable amount of water until impact with a target, yet be designed so that a person would not be injured if accidentally impacted by the projectile. The projectile should be robust enough to be repeatedly used. Furthermore, the projectile should be inexpensive to manufacture and easy to use, with as few moving parts as possible.

Previous toy designs have included hollow balls designed to surround a flexible membrane, such as a water balloon. The membrane is ruptured when the ball impacts a target or when a predetermined time has elapsed. These designs require a water balloon for proper use and are not true replacements for water balloons. Another ball design includes two flexible plastic hemispheres. The hemispheres are filled with water and held together by vacuum pressure that is created when air is squeezed from the hemispheres. Although this design does not require a water balloon, it is significantly more expensive than a water balloon, and the two hemispheres separate easily and can become lost. In addition, in order to work, the hemispheres must be thick, so if the ball hits a person, it may hurt the person because of the ball's substantial mass.

SUMMARY OF THE INVENTION

The present invention overcomes these problems by providing a fluid-holding toy including a flexible container capable of holding fluid. The container has a valve configured to be closed upon the introduction of fluid into the container, whereby the fluid creates a first pressure inside the container closing the first valve. The first valve is configured to be opened upon the occurrence of a second, higher pressure inside the container. The valve can include a flexible flap attached to the inner surface of the container and adapted to cover an opening in the container. A second valve, and even other additional valves can also be provided.

Another aspect of the invention is a method of using a fluid-holding toy including the steps of: providing a flexible vessel with at least one opening formed therein and a stop attached to the vessel and adaptable to selectively close the opening; filling the vessel with fluid through the opening; allowing the fluid pressure inside the vessel to cause the stop to seal and thereby prevent fluid from exiting the opening; propelling the toy toward a target; and employing the force of impact of the toy against the target to open the stop and permit the fluid inside the container to exit through the opening.

DETAILED DESCRIPTION AND BEST MODE OF CARRYING OUT THE INVENTION

Figure 1:
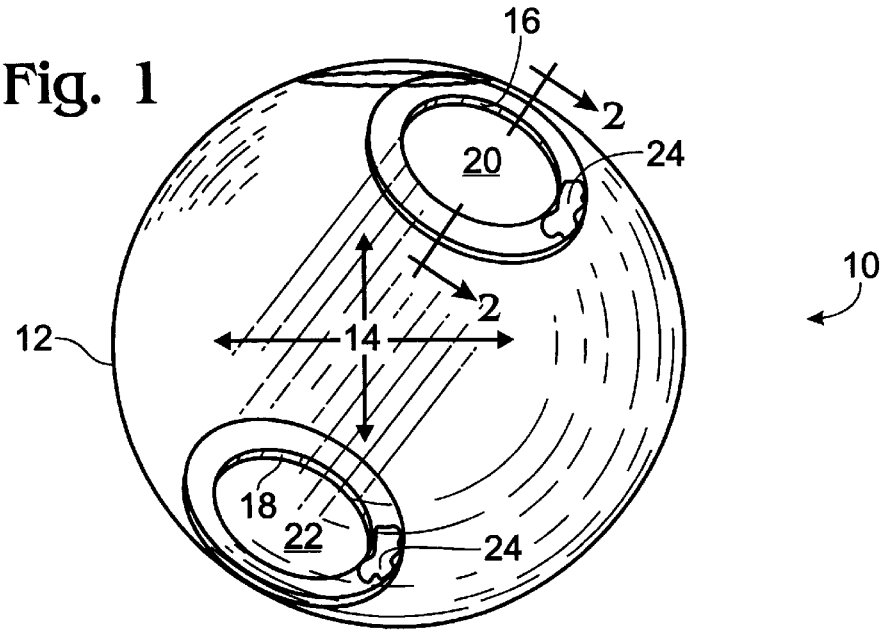
FIG. 1 is a perspective view of the reusable water-containing projectile of the present invention.

FIGS. 1–4 show a preferred embodiment of the reusable water-containing toy 10 of the present invention. Toy 10 includes a hollow vessel or container 12 that substantially encloses a three-dimensional space or volume 14. In the depicted embodiments container 12 is substantially spherical in shape, but can also be ovoid, egg-shaped, or other shapes. Container 12 can be made of a flexible material such as silicone, plastic, rubber, Kraton, or a similar material. Container 12 is typically transparent or translucent, but may also be opaque. Container 12 includes at least one valve to control water flow into and out of the container. In the depicted embodiment, the at least one valve takes the form of first and second openings 16, 18 which are preferably disposed on opposite sides of the container and which are respectively covered by first and second stops or flaps 20, 22. Each opening 16, 18 is shown as a circular aperture, but may take different shapes or forms, such as a slit. Flaps 20, 22 are shaped somewhat larger than their respective openings. Flaps 20, 22 are attached via adhesive 24 to the inner surface 26 of container 12. Flaps 20, 22 are of sufficient size and flexibility to pivot inwardly into volume 14 and at least partially outwardly through the respective openings 16, 18. Preferably, the material from which container 12 and flaps 20, 22 are made has a "tacky" or semi-adhesive characteristic so that the flaps have a tendency to slightly adhere to inner surface 26. Silicone, Kraton, rubber, and some types of plastic possess the necessary characteristics of flexibility and tackiness. The flaps can be replaced with attachments having different shapes and forms.

Figure 3:
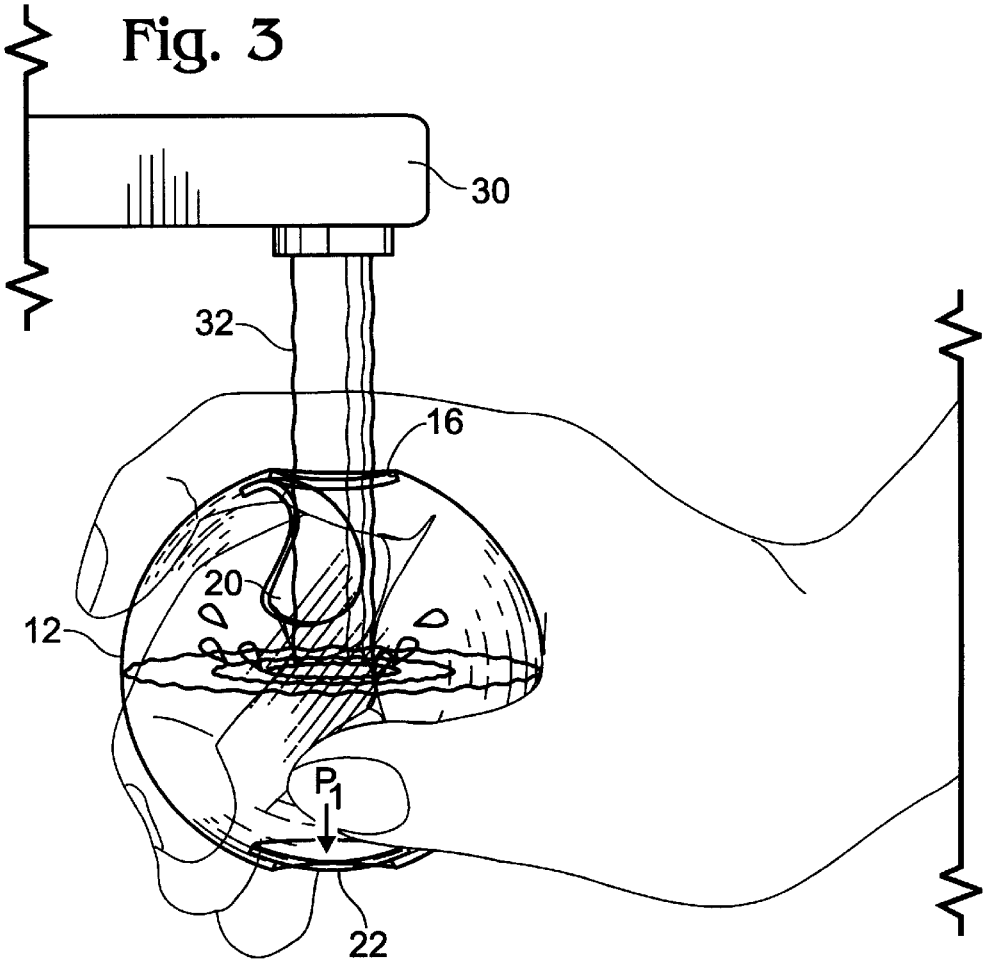
FIG. 3 is a side elevational view of the projectile of the present invention during a filling operation.

In operation, a user holds container 12 under a fluid source, such as a water faucet 30, so that fluid such as water 32 forces first flap 20 to pivot inwardly as shown in FIG. 3. Water 32 enters container 12 through first opening 16. The weight of water 32 creates a first pressure $P_1$ that holds second flap 22 against inner surface 26 and prevents water 32 from exiting through second opening 18. Container 12 is filled until water 32 occupies as much of volume 14 as possible. The transparent or translucent nature of container 12 permits the user to visually inspect the amount of water 32 inside container, although it is not necessary that the container be translucent or transparent because a user can see when the container is full by the flap starting to rise. A watertight seal is created between inner surface 26 and first flap 20 by removing container 12 from under faucet 30 and tilting the container so that water 32 abuts first flap 20. First pressure $P_1$ forces first flap 20 against inner surface 26 and prevents water 32 from exiting through second opening 18.

First pressure $P_1$ continues to hold second flap 22 against inner surface 26. Water pressure and/or air pressure thereby holds both flaps in a closed position. Even if container 12 is held so that one of the openings is situated vertically above water 32 and therefore is not acted upon by first pressure $P_1$, the "tacky" or self-adhesive character of inner surface and flaps maintain the flaps in a closed position. A user may also give the container a slight squeeze to help seal the flaps.

Figure 4:
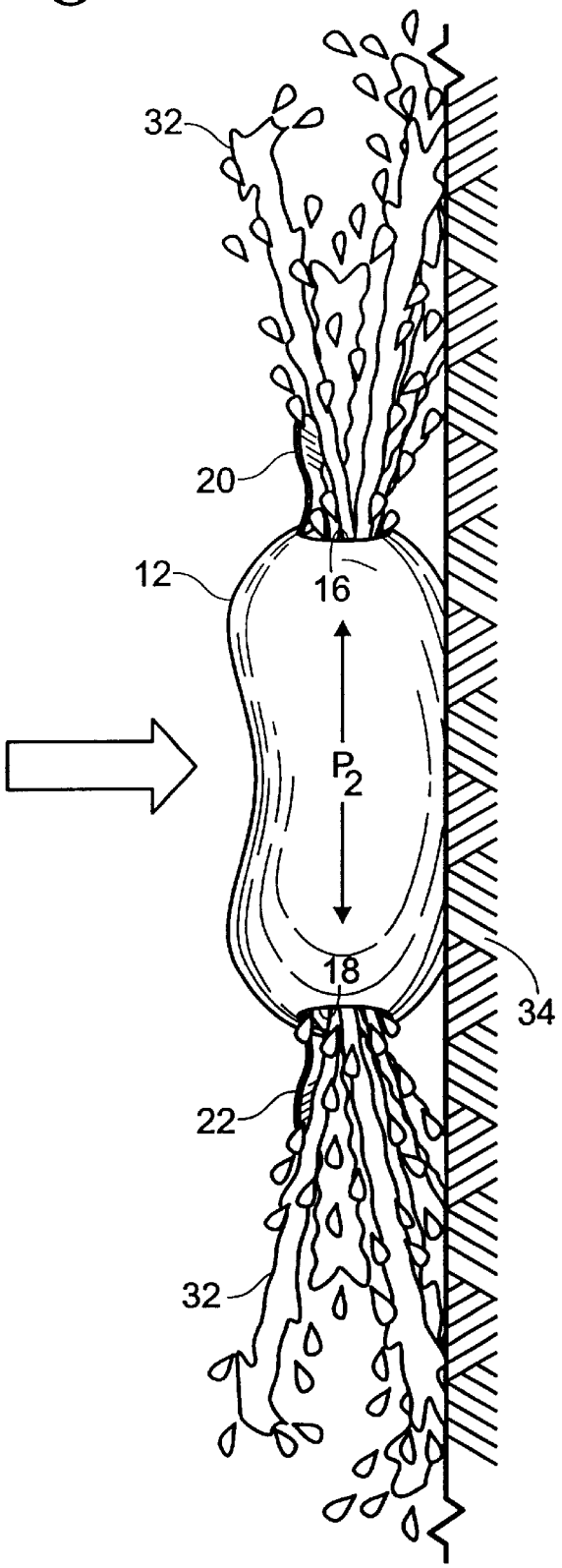
FIG. 4 is a side view of the projectile of the present invention upon impact with a target.

Once container 12 is filled, the user can throw it toward a target 34, as shown in FIG. 4. When container 12 strikes target 34, the force of impact against the target creates a second pressure $P_2$ inside the container. Second pressure $P_2$ is greater than first pressure $P_1$ and is defined as a pressure sufficient to force flaps 20, 22 to pivot outwardly and at least partially through openings 16, 18, respectively. Water 32 exits container 12 through openings 16, 18 and douses target 34. To reuse toy 10, the user pushes flaps 20, 22 inside container 12 and fills the container as described above.

Figure 5:
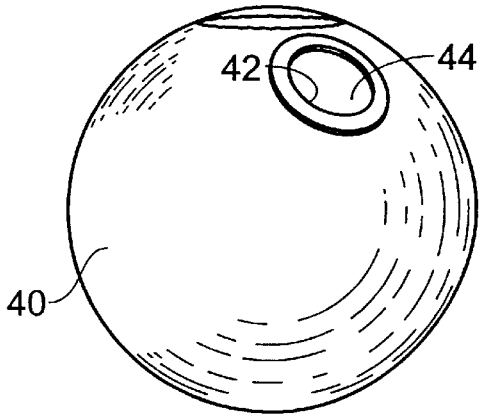
FIG. 5 is a perspective view of another embodiment of the present invention.
Figure 2:
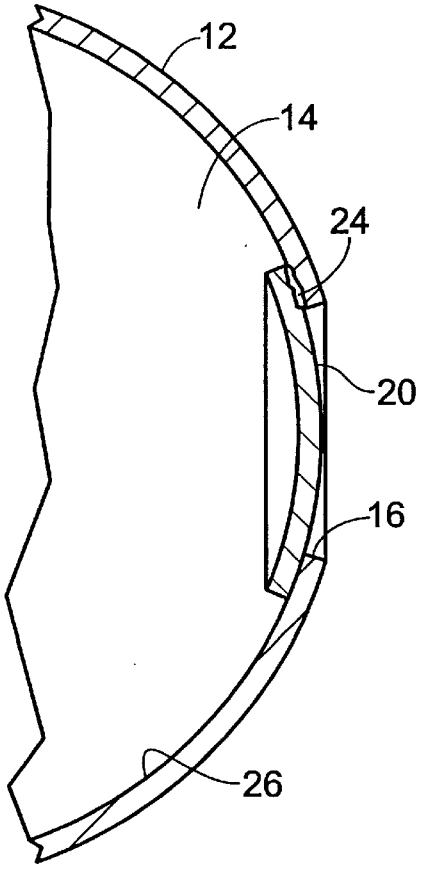
FIG. 2 is a sectional view taken along lines 2—2 of FIG. 1.
Figure 6:
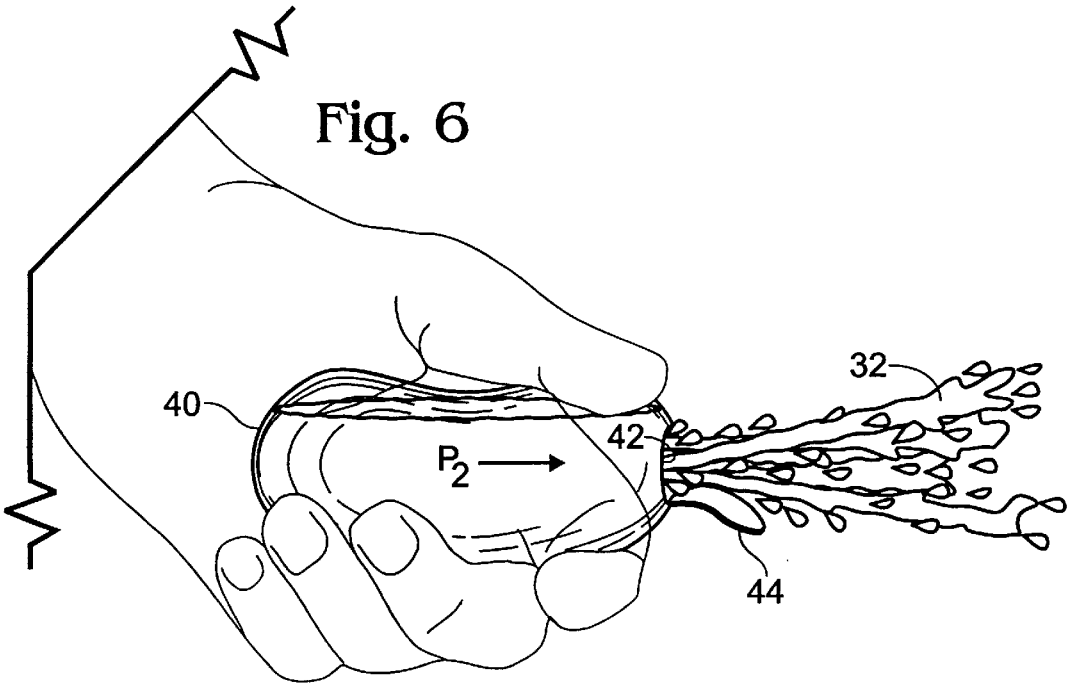
FIG. 6 is a side elevational view of a method of using the embodiment shown in FIG. 5.

Container 12 has been described as having two valves, each including an opening and a flap. However, the present invention can have more or less than two valves. For example, the embodiment shown in FIGS. 5-6 has a container 40 with a single valve that includes an opening 42 and a flap 44. Although container 40 can be thrown toward a target, it can also be used when it is not desired to throw the toy. Container 40 is filled in a manner similar to container 12. As shown in FIG. 6, the user holds container 12 with opening 42 facing a given direction. The user squeezes container 12, creating second pressure $P_2$ and forcefully expelling water 32 through opening 42 toward a target. The size and shape of opening 42 can be varied to optimize both the rate at which water 32 is expelled and the distance the water is propelled.

Figure 7:
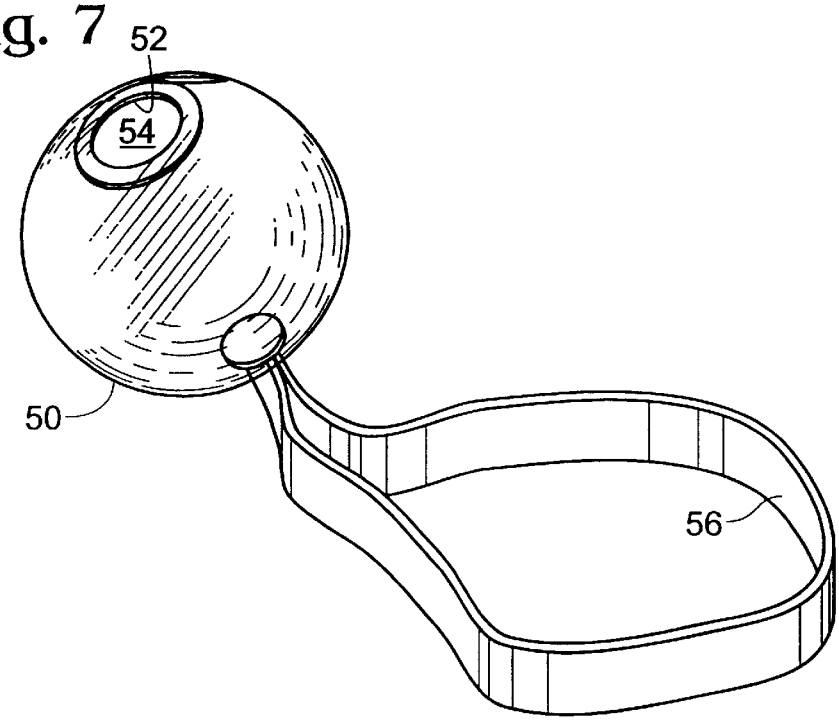
FIG. 7 is a perspective view of another embodiment of the present invention.

FIG. 7 shows another embodiment of the present invention that also has a container 50 with a single valve that includes an opening 52 and a flap 54. An energy-storing member in the form of an elongate tail 56 is attached to container 50, preferably at a position opposite opening 52 and flap 54. Tail 56 is preferably made of an elastic material that stores elastic potential energy when stretched by a user and transforms the elastic potential energy into kinetic energy when released by the user. To use this embodiment, the user fills container 50 with water as previously described. The user holds the end of tail 56 with one hand and pulls container 50 toward his or her body, thus stretching the tail and storing elastic potential energy therein. The user must take care not to squeeze container 50 so that water is forced out of opening 50. When the user releases container 50, the elastic potential energy stored in the stretched tail is converted to kinetic energy and propels the container toward a target.

Alternatively, tail 56 may be non-elastic. To launch container 50 having a non-elastic tail, the user holds the end of tail 56 and swings the container to build up centrifugal force. When the user releases tail 56, container 50 is propelled toward a target.

Although the present invention could be embodied in many different threedimensional shapes, the substantially spherical shape shown in the depicted embodiments is preferred because it resembles the shape of an actual water balloon. In addition, since a spherical shape holds the most volume of any shape for a given surface area, the depicted embodiments are typically less expensive to manufacture than other shapes because less material is required to enclose a desired volume.

One advantage of the present invention as compared to previous toy projectiles is the simplicity of the design. Unlike other reusable water projectiles that rely on complex mechanisms to contain and release water, the present invention relies on fluid pressure to hold water inside the container and to release the water upon impact with a target. The simple design is easy to manufacture and more closely resembles an actual water balloon than previous designs.

Still another advantage is that the container is made of a flexible, lightweight and thin material so that it will not injure a person that is accidentally hit by the toy.

Another advantage is that the present invention is completely selfcontained. To use the present invention, the only thing that needs to be added is fluid such as water.

The toy also stays together on impact with a target, permitting the toy to be reused, and eliminating the small pieces of water balloons that have heretofore created choking hazards for small children.

INDUSTRIAL APPLICABILITY

The present invention is ideally suited for water activities. The foregoing description of the preferred embodiments of the invention has been presented for purposes of illustration and description. It is not intended to be exhaustive or to limit the invention to the precise form disclosed, and many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined only by the issued claims.

I claim:

1. A fluid-holding toy, comprising:

a flexible container capable of holding fluid, the container having an inner surface and a first valve configured to be closed upon the introduction of fluid into the container, whereby the fluid creates a first pressure inside the container closing the first valve, and wherein the first valve is configured to be opened upon the occurrence of a second, higher pressure inside the container; wherein the first valve includes a first opening in the container and a first flexible flap attached to the container, the first flap adapted to selectively cover the first opening; and wherein the inner surface of the container and the first flap cooperate to form a seal to prevent fluid from exiting the first opening when subject to the first pressure.

2. The fluid-holding toy of claim 1, wherein the container has a second valve configured to be closed upon the introduction of fluid into the container, whereby the first pressure closes the second valve, and wherein the second valve is configured to be opened upon the occurrence of the second pressure.

3. The fluid-holding toy of claim 2, wherein the first and second valves are substantially oppositely disposed on the container.

4. The fluid-holding toy of claim 1, wherein the container has a substantially spherical shape.

5. The fluid-holding toy of claim 1, wherein the container has a substantially ovoid shape.

6. The fluid-holding toy of claim 1, wherein the container is made of one of silicone, plastic, rubber, and Kraton.

7. The fluid-holding toy of claim 1, wherein the first flap is operative to be forced through the first opening when subject to the second pressure.

8. The fluid-holding toy of claim 1, wherein the first flap is made of one of silicone, plastic, rubber and Kraton.

9. The fluid-holding toy of claim 1, wherein the first flap is hingedly attached to an inner surface of the container.

10. The fluid-holding toy of claim 1, further comprising an elongate member attached to the container.

11. The fluid-holding toy of claim 10, wherein the elongate member is capable of storing elastic potential energy that is transformable to kinetic energy.

12. The fluid-holding toy of claim 1, wherein the container is transparent.

13. A fluid-holding toy throwable toward a target, comprising:

a flexible vessel capable of holding fluid therein, the vessel having an opening; and a stop attached to the vessel and operative to control the flow of fluid through the opening, the stop having a first state in which fluid enters through the opening but is prevented from exiting through the opening, the stop having a second state in which fluid exits through the opening;

wherein the stop includes a flexible flap adapted to selectively cover the opening; and wherein the inner surface of the vessel and the flap cooperate to form a seal to prevent fluid therein from exiting the opening.

14. A fluid-holding toy throwable toward a target, comprising:

a flexible container for holding fluid, the container defining a volume and having an inner surface;

an opening in the container; and a flap attached to the inner surface so that fluid is allowed to flow into the container through the opening, the flap responsive to fluid pressure inside the container to prevent fluid inside the container from exiting through the opening until the toy strikes a target, at which time the flap is forced through the opening and the fluid exits from inside the container.

15. The fluid-holding toy of claim 14, the flap overlying the opening and extending past the opening to contact a portion of the inner surface adjacent the opening to thereby close the opening.

* * * * *